US007140061B2

(12) United States Patent
Baker et al.

(10) Patent No.: US 7,140,061 B2
(45) Date of Patent: Nov. 28, 2006

(54) SYSTEM FOR PRESERVING PAINTBRUSH BRISTLES

(76) Inventors: Diane A. Baker, 2141 Broadmoor Dr. East, Seattle, WA (US) 98112; Malcolm D. Plant, 1963 Thousand Oaks Blvd., Berkeley, CA (US) 94707

( * ) Notice: Subject to any disclaimer, the term of this patent is extended or adjusted under 35 U.S.C. 154(b) by 165 days.

(21) Appl. No.: 10/461,179

(22) Filed: Jun. 12, 2003

(65) Prior Publication Data

US 2004/0250840 A1 Dec. 16, 2004

(51) Int. Cl.
*A46B 17/04* (2006.01)

(52) U.S. Cl. ..... 15/168; 15/169; 15/184; 15/246; 15/247

(58) Field of Classification Search ..... 15/169, 15/247, 184, 248.1, 168, 246; 205/381
See application file for complete search history.

(56) References Cited

U.S. PATENT DOCUMENTS

| | | | | | |
|---|---|---|---|---|---|
| 530,386 | A * | 12/1894 | Boeckh, Jr. | ..... | 15/168 |
| 634,570 | A * | 10/1899 | Briggs | ..... | 15/168 |
| 1,359,650 | A * | 11/1920 | Amis | ..... | 206/361 |
| 1,380,651 | A * | 6/1921 | Huff | ..... | 15/173 |
| 1,612,887 | A * | 1/1927 | Saunders | ..... | 206/361 |
| 2,485,068 | A * | 10/1949 | Santana | ..... | 206/361 |
| 2,550,248 | A * | 4/1951 | Holton | ..... | 206/361 |
| 2,886,842 | A * | 5/1959 | Larsen | ..... | 15/193 |
| 2,963,731 | A * | 12/1960 | Hoots | ..... | 15/247 |
| 3,325,847 | A * | 6/1967 | Meranto | ..... | 15/184 |
| 4,129,918 | A | 12/1978 | Lee | | |
| 4,144,611 | A | 3/1979 | Brown | | |
| 4,222,193 | A | 9/1980 | Beck | | |
| 4,575,893 | A * | 3/1986 | Rozier | ..... | 15/171 |
| 4,642,837 | A * | 2/1987 | Nichols et al. | ..... | 15/171 |
| 4,751,762 | A | 6/1988 | Meimeteas | | |
| 4,754,685 | A | 7/1988 | Kite et al. | | |
| 4,847,939 | A | 7/1989 | Derencsenyi et al. | | |
| 5,197,370 | A | 3/1993 | Gladfelter | | |
| 5,505,117 | A | 4/1996 | Dunlap et al. | | |
| 5,619,903 | A | 4/1997 | Rogers et al. | | |
| 6,199,694 | B1 | 3/2001 | Van Diest et al. | | |
| 6,227,094 | B1 | 5/2001 | Taylor et al. | | |
| 6,269,515 | B1 * | 8/2001 | Varma | ..... | 15/160 |
| 6,658,689 | B1 * | 12/2003 | Vosbikian | ..... | 15/176.2 |

* cited by examiner

*Primary Examiner*—Randall Chin
(74) *Attorney, Agent, or Firm*—Seed IP Law Group PLLC

(57) ABSTRACT

A system and method for protecting bristles that includes a sleeve sized and shaped to be slideably received over a handle attached to the bristles, the sleeve formed of breathable material to facilitate drying of the bristles, and the sleeve formed of rigid material to support the handle and the bristles in a vertical orientation and to protect the bristles, the sleeve formed of a length sufficient to cover the bristles, and to cover at least a portion of the handle. In accordance with a method of the invention, the sleeve is slid over the proximal end of the handle and moved down the handle to a position where the sleeve covers the bristles and a first end of the sleeve extends beyond the bristles, and the handle is placed in a vertical orientation so that the first end of the sleeve bears against a supporting surface to hold the handle and the bristles in a vertical orientation.

16 Claims, 2 Drawing Sheets

SYSTEM FOR PRESERVING PAINTBRUSH BRISTLES

BACKGROUND OF THE INVENTION

1. Field of the Invention

The present invention pertains to preserving and enhancing the life of bristles used in painting, and more particularly, to a tubular device and method of use that protects the bristles, aids in drying the bristles, and enables storing of the bristles in a vertical orientation.

2. Description of the Related Art

High quality artists' brushes have bristles that are made from very fine hair of animals', sophisticated synthetic fiber, a combination of animal hair and synthetic fiber, or even human hair. These bristles may, for example, be obtained from the hair of camels, goats, horses, badger, and even squirrels. Guard hair, which is a longer, stiffer hair that protects animals, can be found on the tails and coats of most animals, and is generally known as sable. Sable can be obtained from a variety of animals, including Asiatic mink, Chinese weasel, and skunk, although the hair of commercial importance is that from badger, pony, goat, ox-ear, and bear. Regardless of the source, high quality bristles are expensive and require care to maintain their useful life.

Although paintbrush bristles are used to transfer paint or other liquid substance to a surface, they also function as a reservoir for the paint. Paint is wicked up into the bristles when the brush is dipped in the paint, and then dispensed as the bristles are drawn across a surface. Allowing paint or cleaning material to dry on the bristles can shorten their useful life. However, even new bristles can be ruined if improperly stored, such as when they are dried or placed in a bent or twisted position.

Allowing bristles to dry by laying the brush on its side can result in bending of the bristles as they droop downward. In addition, this allows liquid wicked up into the bristles to remain in that portion of the bristles protected by the metal ferrule that aids in holding them to the handle. Moreover, wooden handles can deteriorate in the area where bristles are attached, and moisture can cause the wood encased by the ferrule to expand, causing the connection between the ferrule and the handle to loosen and bristles to be lost.

Although devices have been provided that hold paintbrushes in a vertical orientation with the bristles pointing downward to aid in proper drying and storage, these devices can be expensive, cumbersome, and not easily portable. Hence, there is a need for a lightweight, compact, and relatively inexpensive device for protecting the bristles and enabling them to be dried and stored in a vertical or near vertical orientation.

BRIEF SUMMARY OF THE INVENTION

The disclosed and claimed embodiments of the invention are directed to a system and method for preserving bristles. In accordance with a method for preserving bristles attached to the distal end of an elongate handle having a reduced diameter proximal end, the steps include: providing an elastomeric sleeve formed of breathable and stretchable material that returns to its shape, the sleeve sized and shaped to be slideably received over the reduced-diameter proximal end of the handle, the sleeve having a first end support the bristles and handle in a vertical or upright position on a supporting surface; sliding the sleeve over the proximal end of the handle; and moving the sleeve down the handle to a position where the sleeve covers the bristles. Ideally, the first end of the sleeve extends beyond the farthest bristle.

In accordance with another aspect of the foregoing method, the handle and sleeve are placed in a vertical orientation so that the first end of the sleeve is bearing against a supporting surface and holding the handle in a vertical orientation.

In accordance with a system for protecting bristles, a handle is provided that has the bristles attached at a distal end, the handle having an elongate shape. In one embodiment, the handle has a substantially circular cross-sectional shape with an increased diameter between a distal end and a midpoint and a reduce diameter at a proximal end. The system further includes a resilient sleeve configured to stretch, i.e., expand and contract in diameter and having openings to permit air to pass therethrough. Ideally, the sleeve is formed of rigid material to support the handle and bristles in a vertical orientation with the bristles pointing down. Moreover, this sleeve is of a sufficient length to at least cover the bristles and to be stable when holding the handle in the upright position.

In accordance with another aspect of the foregoing system, the sleeve is formed of a unitary piece of tubular-shaped material. Ideally, the material is resistant to deterioration in liquids, especially in water. Suitable material includes engineered plastics, such as polyethylene, polyurethane, and the like as known to those skilled in the art.

As will be readily appreciated from the foregoing description, the present invention provides a lightweight, compact, and inexpensive protection for bristles. The sleeve is easily and quickly slid down the handle from the proximal end so as not to bend or damage the bristles. The sleeve expands and contracts to accommodate any shape of handle. In addition, the sleeve has a sufficient length to cover the bristles, extend slightly beyond the longest bristle, and to bear against at least the ferrule portion to protect the bristles and to be stable enough to hold the handle and bristles in a vertical orientation with the bristles pointing down. Openings in the sleeve facilitate drying of the bristles.

BRIEF DESCRIPTION OF THE SEVERAL VIEWS OF THE DRAWING(S)

The foregoing and other features and advantages of the present invention will be more readily appreciated as the same become better understood from the accompanying drawings, wherein.

DETAILED DESCRIPTION OF THE INVENTION

Figure 1A:
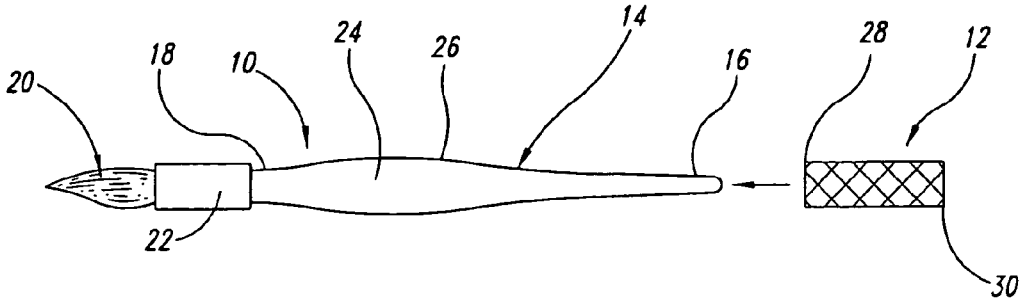
FIGS. 1A–1C illustrate application of the sleeve to the paintbrush.
Figure 1B:
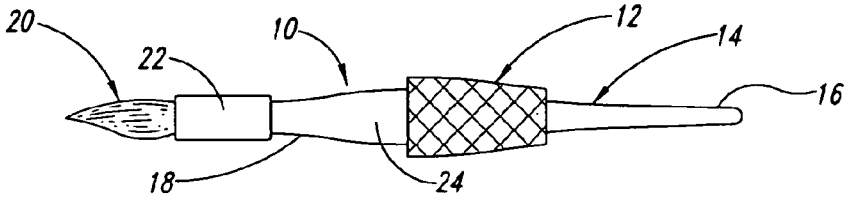
Figure 1C:
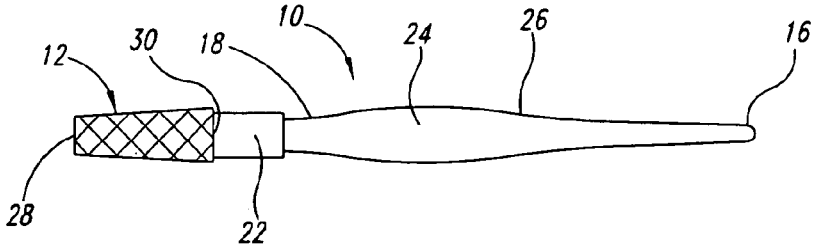

Referring to FIGS. 1A–1C, shown therein is a paintbrush 10 used in conjunction with a sleeve 12 formed in accordance with the present invention. The paintbrush is of conventional construction and includes a handle 14 having a proximal end 16 and a distal end 18. Bristles 20 are attached at the distal end 18 with the aid of a ferrule 22 attached thereto. Most paintbrushes include an enlarged section 24 located between the ferrule 22 and a midpoint 26 on the handle 14.

Most paintbrushes are formed to have a circular cross-sectional configuration wherein the diameter is greatest at the enlarged section 24 and at its smallest at the proximal end 16. The diameter reduces at the distal end 18, but it is not as small as at the proximal end 16.

Figure 2:
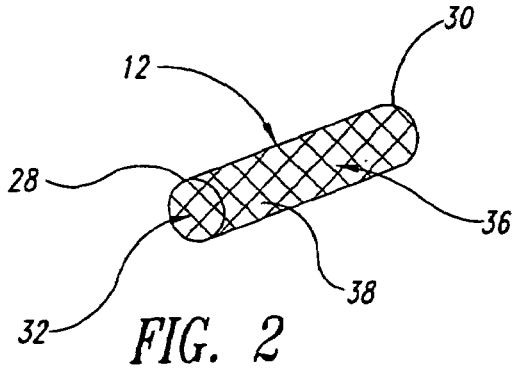
FIG. 2 is an isometric illustration of a sleeve formed in accordance with the present invention.
Figure 3:
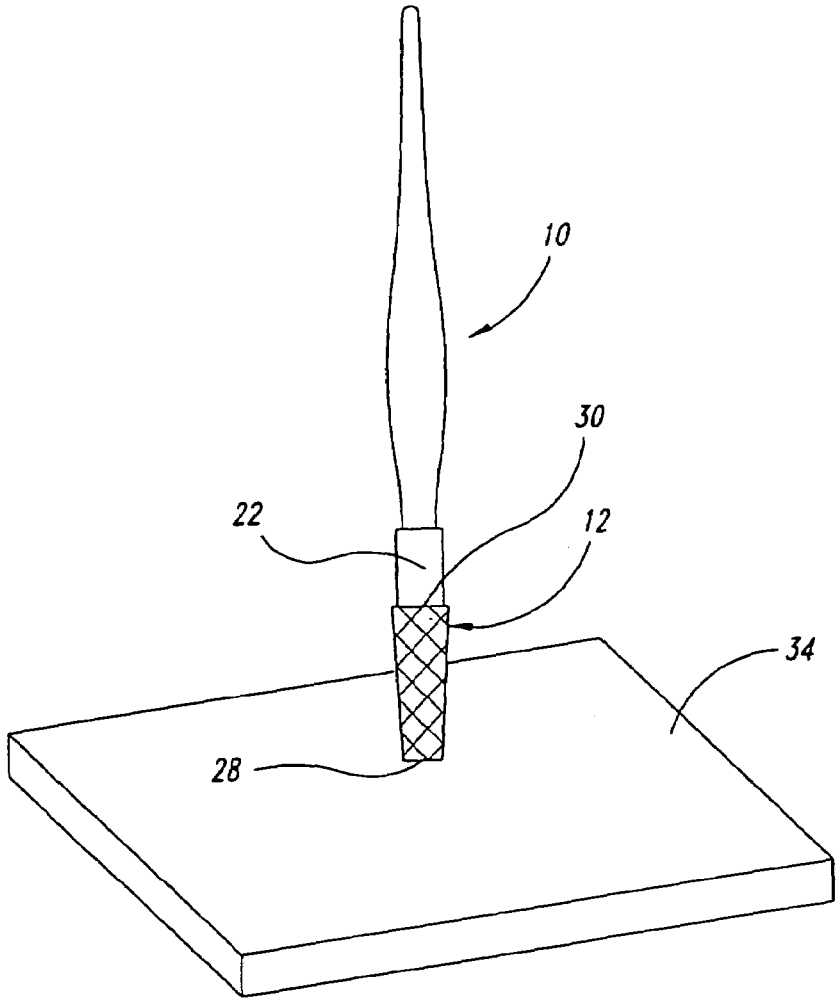
FIG. 3 shows the applied sleeve holding the paintbrush and bristles in a vertical orientation.

As shown in FIG. 2, the sleeve 12 is preferably formed to have a tubular shape and includes a first end 28 and second end 30 that are both open to provide access to a longitudinal axial bore 32 that is sized and shaped to be received over at least the proximal end 16 of the handle 14. The first end 28 is also sized and shaped to support the paintbrush 10 in a vertical orientation, as shown in FIG. 3, when placed against a supporting surface 34.

Ideally, the sleeve 12 is formed of material that does not deteriorate when exposed to water, paint, cleaning solutions, and the like. For example, the sleeve 12 may be formed of engineered polymers or engineered plastics, such as polyethylene, polyurethane, and the like, although it may be formed of any plastic-like material, or other material including braided metal, such as stainless steel, that will not rust, oxidize, or damage the bristles when in contact with the bristles for sustained periods of time. The sleeve 12 is constructed to expand and contract, as well as to bend. This is due in part to the type of material used to construct the sleeve as well as to the construction of the sleeve itself. In one embodiment, a woven material can be used that enables the sleeve to expand, yet it is resilient so as to urge the sleeve to return to its original size. This allows the sleeve to be slid over the small end 16 of the brush handle 14, expand when passing over the enlarged portion or section 24, and contract again around the ferrule 22 and the bristles 20.

The sleeve 12 should have a sufficient length to cover the bristles 20 and at least a portion of the ferrule 22, and to enable the sleeve 12 to be stable when supporting the brush 10 in an upright position on the supporting surface 34. In addition, the sleeve 12 should be constructed of material or in a fashion that allows air to permeate the sleeve. This is to facilitate drying of the bristles, wherein water or cleaning solution can evaporate through the sleeve 12. In one embodiment, openings 36 are formed in the sidewall 38 of the sleeve 12.

In use, the sleeve 12 is positioned coaxial with the paintbrush 10 so that the first end 28 of the sleeve 12 is aligned with the proximal end 16 of the handle 14. The sleeve 12 is then slid over the handle 14, past the enlarged section 24, and over the ferrule 22 a sufficient distance to cover the bristles 20 and, ideally, extend slightly beyond the end of the longest bristle. The second end 30 of the sleeve 12 should bear against at least the ferrule 22, as shown in FIG. 1C. The paintbrush 10 can then be placed in a vertical orientation on a supporting surface 34, as shown in FIG. 3. With the bristles 20 pointing downward toward supporting surface 34, liquid, such as water or cleaning solution or paint, can wick downward from inside the ferrule to prevent deterioration of the bristles 20, the ferrule 22, and the handle 14. The sleeve 12 can also be used to protect the brush 10 during transport. The rigidity of the sleeve 12 will prevent the sleeve from bending, and its resilience will maintain its position on the brush 10, preventing it from being driven back up the handle 14 or off the ferrule 22 and the brush bristles 20.

Although a preferred embodiment of the invention has been illustrated and described, it is to be understood that various changes may be made therein without departing from the spirit and scope of the invention. For example, the tubular sleeve can be used with interchangeable bristles, attaching to the ferrule to protect the bristles while in storage or while being transported. In addition, the tube can be rolled up in form of a rolled tube or a croissant that partially unrolls when slid over the handle. This version will have the drawback of possibly snagging the bristles, however, and is not ideal. Thus, the invention is to be limited only by the scope of the appended claims that follow and their equivalents.

The invention claimed is:

1. A system for protecting bristles, comprising:

a handle having a distal end and a proximal end, the handle having the bristles attached at the distal end, the handle formed to have an elongate shape and a circular cross-sectional configuration;

a stretchable sleeve sized and shaped to be slideably received over the handle and to expand and thereafter contract in diameter to accommodate different diameters of the handle, the sleeve formed of a unitary piece of woven material and formed of a length to at least cover the bristles and to cover at least a portion of the handle, the sleeve formed to have a tubular shape with a circular cross-sectional configuration and formed to expand over the handle and contract over the bristles to hold the bristles straight when removed therefrom and that permits air and evaporating liquid to pass therethrough in both directions, and to be rigid in order to support the handle and bristles in a vertical orientation.

2. The system of claim 1, wherein the sleeve is formed of a rolled tube that unrolls to expand and rolls up to contract.

3. The system of claim 2, wherein the sleeve is formed of a plastic-like material that expands in diameter along its entire length and conforms to the shape of the handle.

4. A system for protecting bristles, comprising:

a handle having the bristles attached at a distal end, the handle having an elongate shape with a substantially circular cross-sectional configuration that has an increased diameter between the distal end of the handle and a midpoint of the handle, and a reduced diameter at a proximal end of the handle; and a tubular, stretchable sleeve having a circular cross-sectional configuration and slideably receivable over the handle to cover the bristles and at least a portion of the handle, the sleeve formed entirely of woven material to protect the bristles and prevent the bristles from bending and to be stretchable to expand and thereafter contract in diameter and conform to the increased and decreased diameters of the handle and to support the handle and bristles in a vertical orientation.

5. The system of claim 4, wherein the sleeve is formed of material that enables air and evaporating liquid to pass therethrough in both directions.

6. The system of claim 5, wherein the sleeve is formed of a unitary piece of woven material.

7. The system of claim 4, wherein the sleeve is formed of a rolled tube that unrolls to expand and rolls up to contract.

8. The system of claim 7, wherein the sleeve is formed from woven plastic.

9. A system for protecting bristles associated with a handle, comprising:

a ferrule attached to the bristles and configured for interchangeability with the handle; and a tubular, stretchable sleeve of circular cross-sectional configuration sized and shaped to be slideably received over the ferrule when on the handle, the sleeve formed of resilient woven material that expands to fit over the ferrule and conform to the shape of the ferrule and to contract over the bristles to hold the bristles straight when removed from the ferrule, the sleeve having a first end sized and shaped to support the ferrule and bristles in a vertical orientation.

10. The system of claim 9, wherein the sleeve is sized and shaped to remain attached to the ferrule when the ferrule is detached from the handle.

11. The system of claim 9, wherein the sleeve is formed of a rolled tube that unrolls to expand and rolls up to contract.

12. A system for protecting bristles associated with a handle, comprising:

a ferrule attached to the bristles and configured for interchangeability with the handle; and a tubular, stretchable sleeve sized and shaped to be slideably received over the ferrule when on the handle, the sleeve formed of a unitary piece of woven material that expands and contracts in diameter to fit over the ferrule and contracts over the bristles to hold the bristles straight, wherein the sleeve is sized and shaped to remain attached to the ferrule when the ferrule is detached from the handle and is rigid to support the ferrule and bristles in a vertical orientation.

13. The system of claim 12, wherein the sleeve has a first end sized and shaped to support the ferrule and bristles in a vertical orientation.

14. The system of claim 12, wherein the sleeve is formed of a rolled tube.

15. The system of claim 12, wherein the sleeve is formed of woven plastic material.

16. A system for protecting bristles associated with a handle, comprising:

a ferrule attached to the bristles and configured for interchangeability with the handle; and a stretchable, tubular sleeve sized and shaped to be slideably received over the ferrule when on the handle, the sleeve formed entirely of a unitary piece of woven material that expands and contracts to fit over the ferrule and contracts over the bristles, the sleeve having a length to cover the bristles and at least a portion of the ferrule to hold the bristles straight when removed therefrom and to support the ferrule and bristles in a vertical orientation.

* * * * *